United States Patent [19]

Bergman

[11] 4,416,299

[45] Nov. 22, 1983

[54] COIN LOADER

[75] Inventor: Charles T. Bergman, Watertown, Wis.

[73] Assignee: Brandt, Inc., Watertown, Wis.

[21] Appl. No.: 292,653

[22] Filed: Aug. 13, 1981

[51] Int. Cl.[3] ..... G07D 9/00

[52] U.S. Cl. ..... 133/1 R; 198/549

[58] Field of Search ..... 198/393, 397, 549, 559; 133/3 F, 3 H, 1 R; 221/253, 254

[56] References Cited

U.S. PATENT DOCUMENTS

| | | | |
|---|---|---|---|
| 811,463 | 1/1906 | Webster | 198/549 |
| 1,237,299 | 8/1917 | Clark | 198/549 |
| 3,171,532 | 3/1965 | Weller et al. | 221/253 X |
| 3,229,806 | 1/1966 | Otto . | |
| 3,924,732 | 12/1973 | Leonard | 198/397 X |
| 4,099,609 | 7/1978 | Kieronski et al. | 198/397 X |

OTHER PUBLICATIONS

A one page flyer of Brandt, Inc. "The New 6-Coin Sorter/Counter!".

A one page flyer "Glory MA 3 Coin Lift Conveyor".

A one page flyer "Universal Coin Handling Machine Corporation".

*Primary Examiner*—Stanley H. Tollberg

*Attorney, Agent, or Firm*—Quarles & Brady

[57] ABSTRACT

A coin loader for coin handling or processing machines includes a caster mounted coin bin which has a vertical run of a flexible conveyor belt operating in one side of the bin. A plurality of spaced flights are attached to the conveyor belt with each flight having a ledge portions with a scalloped edge and projecting outwardly from the belt a distance greater than half the diameter of the largest coin to be handled. A comb forms the bottom of the bin and has surfaces which complement the scalloped edges so that coins cannot slip out the bottom of the bin. Coins are lifted from the bin on the flights to a horizontal run of the conveyor belt which leads to a coin discharge point.

4 Claims, 5 Drawing Figures

COIN LOADER

BACKGROUND OF THE INVENTION

This invention relates to coin handling equipment, and particularly to a loader mechanism which conveys coins from a bin and deposits them at an elevated level into a coin handling or processing device.

There are certain types of coin handling and processing machines which can process vast quantities of coins in a relatively short time. For example, high speed sorters will handle a mixture of coins of different denominations and sort them by denomination while counting the quantities of each denomination sorted. Another example are automatic coin wrappers which process coins of a single denomination by forming them into stacks of a particular size and then wrapping the stacks in a paper wrapper. These machines must be continuously provided with a supply of coins if their maximum utilization is to be realized. The high speed sorters and automatic wrappers typically include a hopper in which a quantity of the coins can be periodically dumped. The coins are generally supplied in bags which are heavy and difficult for an operator to manipulate, particularly if they must be lifted to chest or shoulder height to be dumped into the hopper.

To alleviate the problems and difficulties associated with supplying coins in bags to high speed processing equipment, mechanical loaders have been developed which will convey the coins from a floor mounted container to the elevated hopper of the machine. Prior loader mechanism have typically used a conveyor belt having a run which is inclined from the vertical and which has small projections or flights spaced along the belt. The inclined run of the belt passes through the container for the coins and coins rest against the belt and are supported on edge on the small flights as they are carried upwardly to an elevated discharge point. The prior loaders require considerable floor space not only to accommodate the container for coins but also to accommodate the inclined trajectory of the conveyor belt.

I have developed a coin loader mechanism which employs a vertical run of a conveyor belt and yet functions to hold and carry coins upwardly without fear of them falling away from the belt, thereby saving considerable floor space.

SUMMARY OF THE INVENTION

In accordance with the invention there is provided a coin loader including a bin for coins and a powered conveyor belt having a vertical run extending along and upwardly from a vertical wall of the bin, and a horizontal run extending from the top of the vertical run to a discharge point, the belt including a plurality of spaced flights extending outwardly from the belt to hold coins.

Further in accordance with the invention, each flight includes a scalloped edge which passes through a comb at the bottom of the bin that has complementary surfaces which prevent coins from falling through the bottom of the bin.

It is a principal object of the invention to provide a floor mounted coin loader mechanism which utilizes a minimum of floor space.

It is another object of the invention to provide a coin loader in which coins are carried vertically from a floor mounted coin bin to an elevated level and are then transported horizontally to a point of discharge.

The foregoing and other objects and advantages of the invention will be apparent from the detailed description which follows. In the description, reference is made to the accompanying drawings which illustrate a preferred embodiment of the invention.

DETAILED DESCRIPTION OF THE PREFERRED EMBODIMENT

Figure 1:
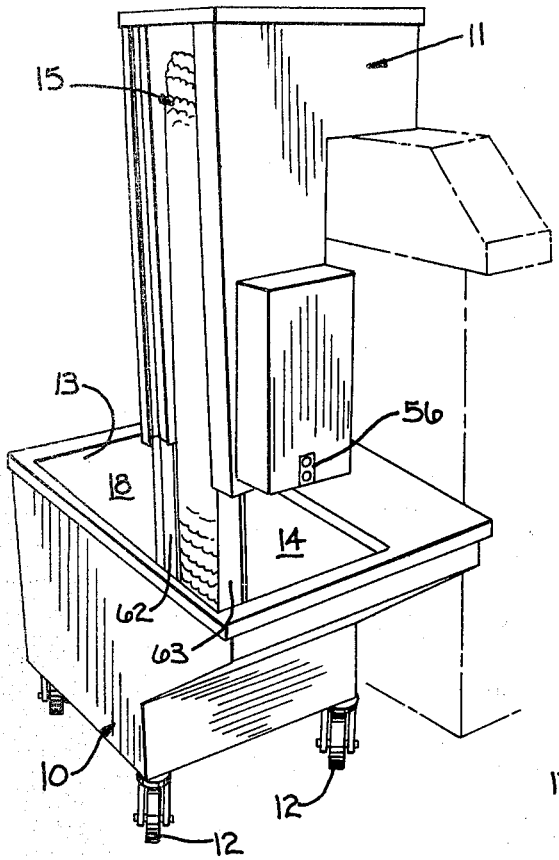
FIG. 1 is a view in perspective of the coin loader in accordance with this invention.
Figure 4:
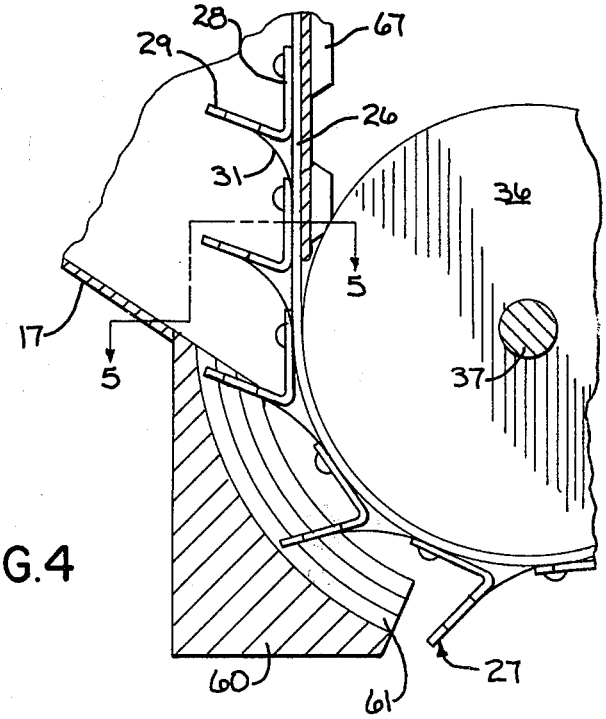
FIG. 4 is a view in vertical section to an enlarged scale showing the cooperating flights and comb at the base of the bin of the coin loader.

The coin loader in accordance with this invention includes a bin 10 which receives coins and a conveyor structure 11 which rises from one side of the bin 10 to carry coins to an elevated and laterally displaced discharge position. The bin 10 is mounted on four castors 12 so that the loader can be wheeled to a position next to a coin processing or handling machine.

The bin 10 has a large open top 13 positioned substantially below waist level of an adult. The interior walls of the bin 10 generally slope towards a low area at the bottom of a vertical interior side wall 14 in which a conveyor 15 operates. An exterior side wall 16 of the bin 10 has a vertical expanse and an inclined portion 17 sloping towards the bottom of the bin 10 and the interior side wall 14. The walls of the bin 10 are completed by a vertical rear wall 18 and an inclined front wall 19. The rear wall 18 includes a short sloped section 20 adjacent the bottom of the bin. As a result of the shape of the interior surfaces and walls of the bin 10, coins deposited therein through the open top 13 will tend to fall towards the low area at the base of the vertical wall 14 and towards the conveyor 15 which operates in that vertical wall 14.

The conveyor structure 11 includes a framework designated generally by the numeral 25 formed of small box beams and plates welded together and mounted to the bin 10 to support the conveyor 15 and the structure for powering the conveyor. The framework 25 consists of two spaced apart side sections which support the conveyor 15 between them.

The conveyor 15 includes a flexible, reinforced belt 26 on which are mounted a plurality of spaced flights 27. Each flight 27 includes a flat mounting portion 28 secured against the surface of the belt 26 and a ledge portion 29 extending from the flat mounting portion 28 at an acute angle. The ledge portion 29 of each flight 27 has an edge 30 which is scalloped or otherwise formed from a series of curves no points of which are on a straight line. The scalloped edges 30 extend furthest away from the mounting portion 28 and the conveyor belt 26 along the major width of each flight 27 and then blend into the lateral edges of each flight 27. Thin sheet plastic flight protectors 31 are sandwiched along one edge between the conveyor belt 26 and the mounting portion 28 of a flight 27. The protectors 31 are bent through a curve and have a free edge in contact with the underside of a ledge portion 29 of the preceeding flight 27. The protectors 31 prevent coins from being caught or lodged between the edge of a mounting portion 28 of one flight 27 and the exterior corner of an adjacent flight 27. The flights 27 have a width which is less than the width of the belt 26 so that free lateral edges remain on each side of the belt.

The conveyor 15 extends about a lower idler roller 36 mounted on a shaft 37 journaled in side plates of the framework 25. A vertical run of the conveyor 15 extends upwardly from the lower roller 36 along the vertical interior side wall 14 of the bin 10 to a first upper roller 38 mounted on a horizontal shaft 39 journaled in upper side plates of the framework 25. A second upper roller 40 mounted on a shaft 41 is spaced in a horizontal plane from the first upper roller 38 and, with the first upper roller 38, defines a horizontal run of the conveyor 15 which leads to a discharge point for coins. The conveyor 15 extends about the periphery of the second upper roller 40 and then follows a return run to a pair of spaced idler rollers 42 mounted on a shaft 43. From the idler rollers 42, the conveyor 15 extends down to and around the lower roller 36. The idler rollers 42 ride on the free lateral edges of the belt 26 outboard of the flights 27. The shaft 43 mounting the idler rollers 42 is journaled in bearings 44 held in brackets 45 which are pivotally secured to the framework 25. Spring loaded rods 46 are secured at one end to the brackets 45 and at their other end to the framework 25. The rods 46 urge the brackets 45 to a position in which the idler rollers 42 are moved towards the first upper roller 38 to thereby take up any slack in the conveyor 15.

Both of the upper rollers 38 and 40 are driven by a toothed belt 50 which extends around pulleys 51 and 52 mounted on outboard portions of the horizontal shafts 39 and 41, respectively. The toothed belt extends around an idler 53 and a pinion pulley 54 driven by an electric motor 55 all mounted on the framework 25. The motor 55 is controlled by an ON-OFF switch 56.

As the conveyor belt 26 passes around the lower pulley 26 and enters the bottom of the bin 10, each flight 27 passes through a comb 60 mounted in the low area at the base of the bin 10. The comb 60 defines the floor of the lowest portion of the bin 10. The comb 60 is a casting which includes arcuate passages 61 which are shaped to complement the scallops on the edge 30 of the flights 27. The arcuate passages 61 within the comb 60 are so formed as to permit spacing the comb 60 from the edges of the flights 27 some distance which is large enough to insure that there is no contact between the flights and the comb 60 but which is small enough to prevent coins from lodging in the space therebetween. The continuous curved shape of the complementary scallops on the flights 27 and in the passages 61 of the comb 60 prevent any coin from falling between the cooperating elements. Because there is no straight line surfaces, the spacing between the scalloped edges 30 and the comb 60 is not critical and normal manufacturing tolerances can be accommodated.

Within the confines of the bin 10, the lateral edges of the conveyor 15 pass between front guide plates 62 and 63 and rear edge supports 64 and 65, respectively, mounted to the vertical wall 14. The front plates and rear edge supports prevent distortion of the conveyor 15 by the weight of coins in the bin 10 pressing against the belt.

The horizontal run between the upper rollers 38 and 40 is also supported by a formed sheet metal pan 66 disposed directly beneath the bottom surface of the conveyor belt 26.

Figure 5:
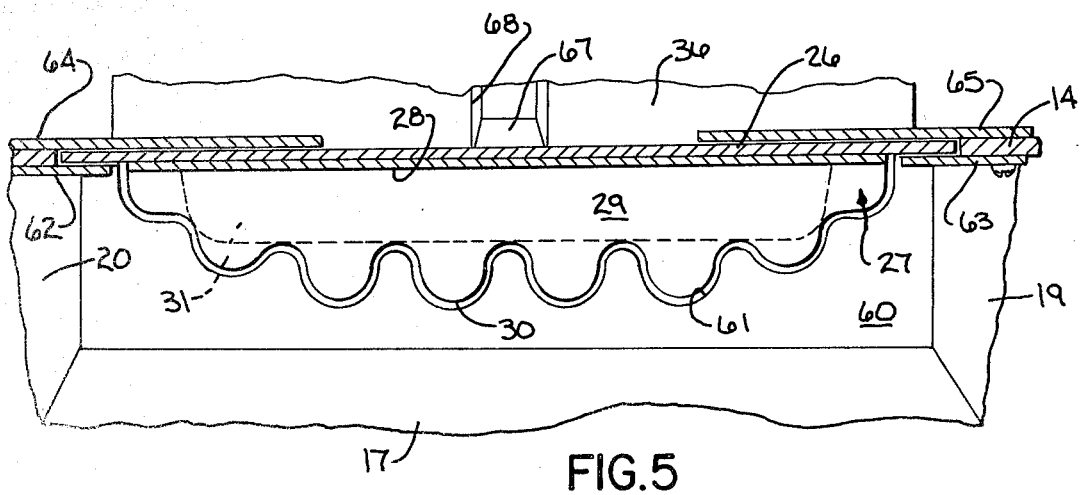
FIG. 5 is a top view taken in the plane of the line 5—5 of FIG. 4.
Figures 2, 3:
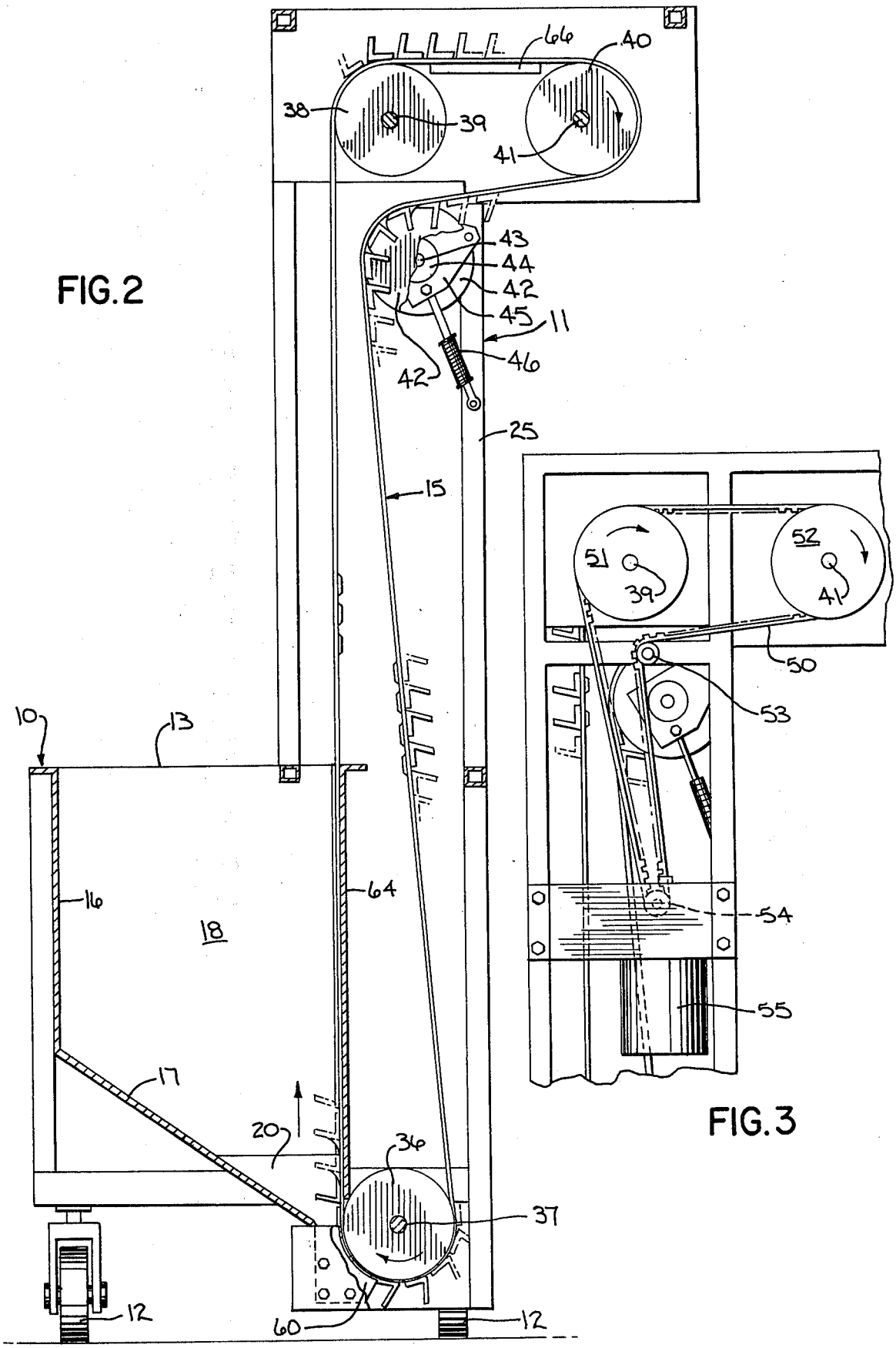
FIG. 2 is view in vertical section through the coin loader.
FIG. 3 is a side view in elevation of the driving mechanism for the conveyor belt of the coin loader.

The conveyor belt 26 is provided with a series of spaced lugs 67 along its rear surface. The lugs 67 ride in peripheral grooves provided in the lower roller 36 and in the upper rollers 38 and 40, and ride in a recess in the pan 66. A typical groove 68 is illustrated in FIG. 5 in the lower roller 36. The lugs 67 cooperate with the recess and grooves to center the belt 26 laterally to thereby insure that it follows a proper path.

In operation, coins would be dumped by an operator into the bin 10 which is at a convenient level. The coins will settle into the bottom of the bin 10 because of its sloping sides and will be engaged by flights 27 on the conveyor 15 as the vertical run of the conveyor 15 moves along side the vertical side 14 of the bin. The ledge portions 29 extend a distance from the surface of the belt 26 which is larger than one-half the diameter of the largest coin being handled. The spacing and shape of the cooperating flights 27 and comb 60 insure that coins will not fall out of the bottom of the bin or be pinched between the comb and the flights. The coins will rest upon the flights 27 as they travel upwardly to the horizontal run where they will be carried to the discharge point at the periphery of the upper roller 40. At that point the coins can be discharged into the hopper of a machine such as the high speed coin sorter or automatic wrapping machine which the floor mounted loader is feeding.

I claim:

1. A coin loader, comprising:

a bin having an open top and including interior walls which slope toward a low area adjacent the bottom of a vertical wall of the bin;

a support framework mounted to the bin and rising therefrom at said vertical wall;

a flexible conveyor belt extending about rollers supported on said framework, said conveyor belt having a vertical run disposed in said vertical wall and extending upwardly therefrom and a horizontal run extending from the top of the vertical run to a discharge point laterally of said bin; said conveyor belt being imperforate to the smallest coins to be handled;

a plurality of flights spaced along said belt and each including a ledge portion which projects away from the surface of said belt a distance greater than one-half the largest diameter of coins to be handled and which terminates in a lateral edge formed from a series of curves;

a comb disposed at said low area of said bin and having surfaces which are spaced from and complement the lateral edge of the flights and through which the flights pass at the bottom of said vertical run; and a motor connected to rotate at least one of said rollers.

2. A coin loader in accordance with claim 1 wherein said vertical wall of the bin includes spaced front and rear vertically extending plates adjacent each side of the conveyor belt, and wherein the edges of the conveyor belt ride in the spaces between the front and rear plates.

3. A coin loader in accordance with claim 1 wherein each flight includes a flat mounting portion secured against the conveyor belt and said ledge portion extends at an acute angle from said mounting portion, and together with a thin sheet protector extending through a curve from each mounting portion to the underside of the ledge portion of the preceeding flight.

4. A coin loader in accordance with claim 1 wherein said belt has a series of spaced lugs aligned longitudinally along the rear surface of said belt and each of said rollers has a peripheral groove which receives said lugs.

* * * * *